US008123220B2

(12) United States Patent
Suzuki

(10) Patent No.: US 8,123,220 B2
(45) Date of Patent: Feb. 28, 2012

(54) SHEET-MEDIUM-CONVEYING DEVICE

(75) Inventor: Nobuhiko Suzuki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 33 days.

(21) Appl. No.: 12/634,275

(22) Filed: Dec. 9, 2009

(65) Prior Publication Data

US 2010/0187753 A1 Jul. 29, 2010

(30) Foreign Application Priority Data

Jan. 29, 2009 (JP) ..... 2009-018515

(51) Int. Cl.
*B65H 7/02* (2006.01)

(52) U.S. Cl. ..... 271/265.02; 271/265.04; 356/71

(58) Field of Classification Search ..... 271/265.02, 271/265.01, 265.04; 356/71, 432
See application file for complete search history.

(56) References Cited

U.S. PATENT DOCUMENTS

| | | | | |
|---|---|---|---|---|
| 5,131,648 | A * | 7/1992 | Ito | 271/262 |
| 5,458,324 | A * | 10/1995 | Nakamura et al. | 271/10.02 |
| 5,506,658 | A | 4/1996 | Takemura et al. | |
| 5,584,472 | A * | 12/1996 | Hidding et al. | 271/3.06 |
| 6,024,355 | A * | 2/2000 | Hidding et al. | 271/3.06 |
| 7,443,490 | B2 * | 10/2008 | Yamagishi et al. | 356/71 |
| 7,690,650 | B2 * | 4/2010 | Itoh et al. | 271/263 |
| 7,817,957 | B2 * | 10/2010 | Oohara et al. | 399/388 |
| 2006/0164456 | A1 | 7/2006 | Yamagishi et al. | |
| 2007/0018383 | A1 * | 1/2007 | Ohara et al. | 271/262 |
| 2007/0063429 | A1 * | 3/2007 | Kang | 271/264 |

FOREIGN PATENT DOCUMENTS

| | | | |
|---|---|---|---|
| JP | 2-110053 | A | 4/1990 |
| JP | 5-72845 | | 3/1993 |
| JP | 5-346699 | | 12/1993 |
| JP | 6-278910 | A | 10/1994 |
| JP | 7-237787 | | 9/1995 |
| JP | 11-124252 | A | 5/1999 |
| JP | 11-220597 | A | 8/1999 |
| JP | 2000-296943 | | 10/2000 |
| JP | 2001-343792 | | 12/2001 |
| JP | 2003-137457 | A | 5/2003 |
| JP | 2006-321215 | | 11/2006 |

OTHER PUBLICATIONS

Japanese Office Action dated Nov. 25, 2010 together with partial English language translation.

* cited by examiner

*Primary Examiner* — Kaitlin Joerger
(74) *Attorney, Agent, or Firm* — Scully, Scott, Murphy & Presser, PC

(57) ABSTRACT

A sheet-medium-conveying device includes a tray, a conveying unit, a detecting unit, a determining unit, and a reference value changing unit. A plurality of sheets to be conveyed are settable on the tray. The conveying unit conveys the sheets on the tray. The measuring unit measures a quantity with respect to the sheet conveyed by the conveying unit. The detecting unit detects an overlapped feed in which at least two sheets are conveyed in a partially overlapped condition. The overlapped feed is detected by comparing the quantity measured by the measuring unit with a reference value. The determining unit is configured to determine whether a type of sheet conveyed by the conveying unit is changed. The reference value changing unit is configured to change the reference value to a value corresponding to the changed type of sheet as determined by the determining unit.

18 Claims, 12 Drawing Sheets

| | |
|---|---|
| THE NUMBER OF SHEETS FOR GROUP 1 | 1 SHEET |
| THE NUMBER OF SHEETS FOR GROUP 2 | INDEFINITE |

FIG.8

INSTRUCTION SHEET (1/2 PAGE)

DOCUMENT FEED
☐ FB ■ ADF SIMPLEX ☐ ADF DUPLEX

DOCUMENT TYPE
■ AUTOMATIC ☐ PHOTO ☐ LETTER

CONTRAST −☐☐☐■☐+

DOCUMENT LAYOUT
☐ LANDSCAPE ■ PORTRAIT
☐ NARROW SIDE BINDING ☐ LONG SIDE BINDING (WHEN ADF DUPLEX)
☐ BOOK (TWO-PAGE SPREAD)

DOCUMENT SIZE
■ A4
☐ LETTER ☐ LEGAL
☐ B5 ☐ A5
☐ POSTCARD

64

INSTRUCTION SHEET (2/2 PAGE)

PRINT
☐ SIMPLEX ■ DUPLEX
☐ NARROW SIDE BINDING ■ LONG SIDE BINDING (WHEN DUPLEX)

PRINT LAYOUT
☐ 1 IN 1
■ 2 IN 1
☐ 4 IN 1

DOCUMENT SIZE
■ A4
☐ LETTER ☐ LEGAL
☐ B5 ☐ A5
☐ POSTCARD

65

| | |
|---|---|
| THE NUMBER OF SHEETS FOR GROUP 1 | 2 SHEETS |
| THE NUMBER OF SHEETS FOR GROUP 2 | INDEFINITE |

72

| | |
|---|---|
| THE NUMBER OF SHEETS FOR GROUP 1 | INDEFINITE |

73

SHEET-MEDIUM-CONVEYING DEVICE

CROSS REFERENCE TO RELATED APPLICATION

This application claims priority from Japanese Patent Application No. 2009-018515 filed Jan. 29, 2009. The entire content the priority application is incorporated herein by reference.

TECHNICAL FIELD

The invention relates to a sheet-medium conveying device and an image-reading device.

BACKGROUND

A medium discrimination device for an image-forming apparatus is known in the art. The image-forming apparatus includes an accommodating unit for accommodating a plurality of overlaid sheets and conveys these sheets one at a time from the accommodating unit onto a conveying path. The medium discrimination device comprises transmitted light quantity measuring means disposed along the conveying path that measures the quantity of light transmitted in the thickness direction of the medium to detect overlapped feeds. The medium discrimination device detects the type of medium when the first sheet is conveyed and performs overlapped-feed detection on each sheet thereafter.

SUMMARY

However, when a plurality of types of media is combined in the accommodating unit of the image-forming apparatus described above, the conventional medium discrimination device may incorrectly detect overlapped feeds because the detected quantity of transmitted light may differ among the different types of media.

In view of the foregoing, it is an object of the invention to provide a sheet-medium-conveying device and an image-reading device capable of accurately detecting overlapped feeds of a sheet-like medium fed from a tray, even when the tray holds media of a plurality of types.

In order to attain the above and other objects, the invention provides a sheet-medium-conveying device. The sheet-medium-conveying device includes a tray, a conveying unit, a detecting unit, a determining unit, and a reference value changing unit. A plurality of sheets are settable on the tray. The conveying unit conveys the sheets on the tray. The measuring unit measures a quantity with respect to the sheet conveyed by the conveying unit. The detecting unit detects an overlapped feed in which at least two sheets are conveyed in a partially overlapped condition. The overlapped feed is detected by comparing the quantity measured by the measuring unit with a reference value. The determining unit is configured to determine whether a type of sheet conveyed by the conveying unit is changed. The reference value changing unit is configured to change the reference value to a value corresponding to the changed type of sheet as determined by the determining unit.

According to another aspect, the invention provides an image-reading device. The image-reading unit includes a tray, a conveying unit, a reading unit, a detecting unit, a determining unit, and a reference value changing unit. The plurality of sheets are settable on the tray. The conveying unit conveys the sheets on the tray. The reading unit reads an image of the sheet conveyed by the conveying unit and generates image data. The measuring unit measures a quantity with respect to the sheet conveyed by the conveying unit. The detecting unit detects an overlapped feed in which at least two sheets are conveyed in a partially overlapped condition. The overlapped feed is detected by comparing the quantity measured by the measuring unit with a reference value. The determining unit is configured to determine whether a type of sheet conveyed by the conveying unit is changed. The reference value changing unit is configured to change the reference value to a value corresponding to the changed type of sheet as determined by the determining unit.

According to still another aspect, the invention provides a sheet-medium-conveying device. The sheet-medium-conveying device includes a tray, a conveying unit, a counter, a length measuring unit, and a controller. The conveying unit is configured to feed a sheet from the tray. The counter is configured to count a number of sheets conveyed by the conveying unit. The length measuring unit is configured to measure a length of the sheet conveyed by the conveying unit. The memory is configured to store a reference length and a reference number. The controller is configured to control the conveying unit, the counter, the length measuring unit, and the memory. If the number of sheets counted by the counter is zero, the controller controls the length measuring unit to measures a length of a sheet conveyed by the conveying unit and stores the measured length of the sheet as a reference length in the memory. If the number of sheets counted by the counter is greater than zero, the controller controls the length measuring unit to measures the length of the sheet conveyed by the conveying unit and compares the measured length with the reference length. If the measured length is greater than the reference length, the controller determines and notifies that an overlapped feed in which at least two sheets are conveyed in a partially overlapped condition occurs whereas if the measured length is smaller than or equal to the reference length, the controller determines that the overlapped feed does not occur and the controller does not notify that the overlapped feed occurs. The controller resets the counter to zero if the number of sheets that the counter counts reaches the reference number.

BRIEF DESCRIPTION OF THE DRAWINGS

The particular features and advantages of the invention as well as other objects will become apparent from the following description taken in connection with the accompanying drawings, in which:

FIG. 8 is an explanatory diagram with enlarged views of the instruction sheets shown in FIG. 7.

DETAILED DESCRIPTION

First Embodiment

A first embodiment of the invention will be described with reference to FIGS. 1 through 14.

Figure 1:
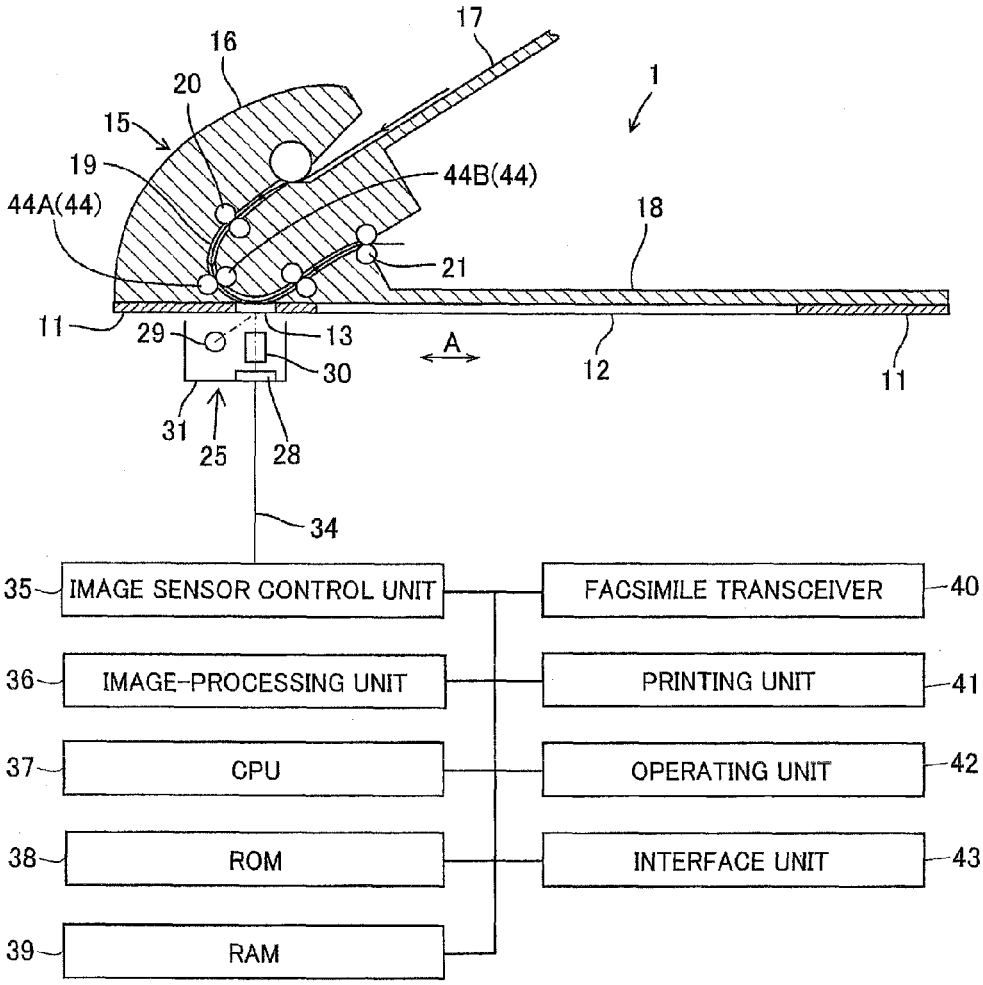
FIG. 1 is a side cross-sectional view conceptually illustrating a multifunction peripheral according to a first embodiment of the invention.

(1) Structure of a Sheet-Medium-Conveying Device and an Image-Reading Device FIG. 1 is a side cross-sectional view conceptually illustrating a multifunction peripheral (MFP) 1. The MFP 1 has a scanner function, printer function, and copier function, facsimile function.

The MFP 1 has a main casing 11 (only partially shown in FIG. 1) that is substantially box-shaped. A first platen glass 12 and a second platen glass 13 are juxtaposed on top of the main casing 11. A document cover 15 serving in the embodiment is coupled to the main casing 11 so as to be capable of rotating between a closed position for covering the first platen glass 12 and an open position for exposing the first platen glass 12. The document cover 15 includes an automatic document feeder (ADF) 16, a document tray 17 for setting paper or another sheet-like medium, and a discharge tray 18.

The ADF 16 has a conveying path 19 defined therein; various types of rollers, including a pair of conveying rollers 20 and a pair of discharge rollers 21; and a stepper motor (not shown) for driving the rollers. The rollers convey the sheet-like medium set in the document tray 17 one sheet at a time so that each sheet passes over the second platen glass 13.

Although not illustrated in FIG. 1, the ADF 16 is capable of conveying a sheet so that the top surface of the sheet is read and can automatically turn over the sheet after the sheet has passed over the second platen glass 13 and convey the sheet back over the second platen glass 13 so that the bottom surface of the sheet is read. Thus, the MFP 1 can automatically scan both surfaces of the sheet.

A reading unit 25 is disposed beneath the upper portion of the main casing 11. The reading unit 25 employs a contact image sensor (CIS) system for scanning an original document and includes a linear image sensor 28 having a plurality of light-receiving elements arranged linearly in a direction (a width direction of the sheet) orthogonal to the surface of the drawing in FIG. 1, a light source 29 configured of light-emitting diodes (LEDs) in the three RGB colors, a rod lens array 30 for forming an image on the light-receiving elements of the linear image sensor 28 from light reflected off the original document, a carriage 31 in which the linear image sensor 28, light source 29, and rod lens array 30 are mounted, and a conveying mechanism (not shown) for conveying the carriage 31. As a variation to this embodiment, the reading unit 25 may employ a minification optical system to scan the original documents.

When scanning an original document placed on the first platen glass 12, the reading unit 25 reads the image while the carriage 31 is conveyed at a constant speed along a sub-scanning direction (indicated by A in FIG. 1) parallel to the surface of the first platen glass 12. When scanning an original document conveyed by the ADF 16, the reading unit 25 reads data while the carriage 31 is halted directly beneath the second platen glass 13.

The MFP 1 also includes an image sensor control unit 35, an image-processing unit 36, a CPU 37, a ROM 38, a RAM 39, a facsimile transceiver 40, a printing unit 41, an operating unit 42, and an interface unit 43.

The image sensor control unit 35 configured of an ASIC (application-specific integrated circuit) is connected to the ADF 16 and the reading unit 25 via a flexible flat cable 34. The image sensor control unit 35 executes processes to control the ADF 16 and the reading unit 25, adjust the gain in image data outputted from the linear image sensor 28, and convert the image data from analog to digital.

The image-processing unit 36 is also configured of an ASIC for receiving image data outputted from the image sensor control unit 35 and performing various processes on this data, such as gamma correction, shading compensation, noise filtering, color balance adjustments, enlargements/reductions, and color space conversion.

The CPU 37 controls each component of the MFP 1 by executing various programs stored in the ROM 38.

The ROM 38 stores the various programs executed by the CPU 37, as described above.

The RAM 39 serves as a primary storage unit employed by the CPU 37 when the CPU 37 executes various processes.

The facsimile transceiver 40 is connected to a telephone exchange via a public telephone network and transmits and receives image data to and from the telephone exchange according to a prescribed facsimile communication protocol.

The printing unit 41 employs a laser method or a inkjet method to form images on sheets of recording media based on image data.

The operating unit 42 includes a plurality of buttons and a liquid crystal display (LCD). A user can input data and instructions by operating the buttons while referencing the screen display on the LCD, for example.

The interface unit 43 is configured of a USB interface and a network interface.

The ADF 16 also includes a photoelectric sensor 44 disposed along the conveying path 19. The photoelectric sensor 44 includes a light-emitting element 44A and a light-receiving element 44B opposing each other across the conveying path 19. The light-emitting element 44A is configured of an LED or the like. The light-receiving element 44B receives light emitted by the light-emitting element 44A and outputs an electric signal corresponding to the intensity of the received light.

The CPU 37 measures the length of a sheet based on electric signals outputted from the photoelectric sensor 44. Specifically, when a sheet of the recording medium conveyed along the conveying path 19 reaches the photoelectric sensor 44, the intensity of light entering the light-receiving element 44B drops because the sheet blocks the light emitted from the light-emitting element 44A. Consequently, the level of the electric signal outputted from the photoelectric sensor 44 also drops. The CPU 37 calculates the distance that the sheet moves from the moment at which the electric signal level changes from high (bright) to low (dark) until the moment at which the level changes from low to high based on the number of times the stepper motor of the ADF 16 rotates during this time, and sets the length of the sheet to this distance.

However, the invention is not limited to this method of measuring the length of a sheet. For example, the document cover 15 may include a movable member disposed in the sheet-conveying path that is dislodged from (moved out of) the path while contacted by a sheet. In this case, the CPU 37 finds the length of the sheet by calculating the distance in which the sheet moves while the movable member is dislodged.

The CPU 37 also counts the number of sheets conveyed by the ADF 16 based on an electric signal outputted from the photoelectric sensor 44. Here, the electric signal outputted from the photoelectric sensor 44 changes from high to low each time a new sheet is conveyed. The CPU 37 counts the number of conveyed sheets by counting the number of times that this electric signal changes in level from high to low.

However, the invention is not limited to this method of counting sheets. For example, the CPU 37 may count the number of conveyed sheets by counting the number of times that the movable member described above is dislodged.

(2) Measured Quantities

The MFP 1 measures a specific quantity that differs during a normal feed in which a single sheet of recording medium is conveyed by the ADF 16, and an overlapped feed (double feed) in which two or more sheets are conveyed simultaneously, and detects a overlapped feed by comparing the measured value with a reference value. The measured quantity in this example is the length of the sheet in the conveying direction (hereinafter simply referred to as "length"). In the embodiment, the length in the conveying direction differs according to the type of sheet.

Figure 2:
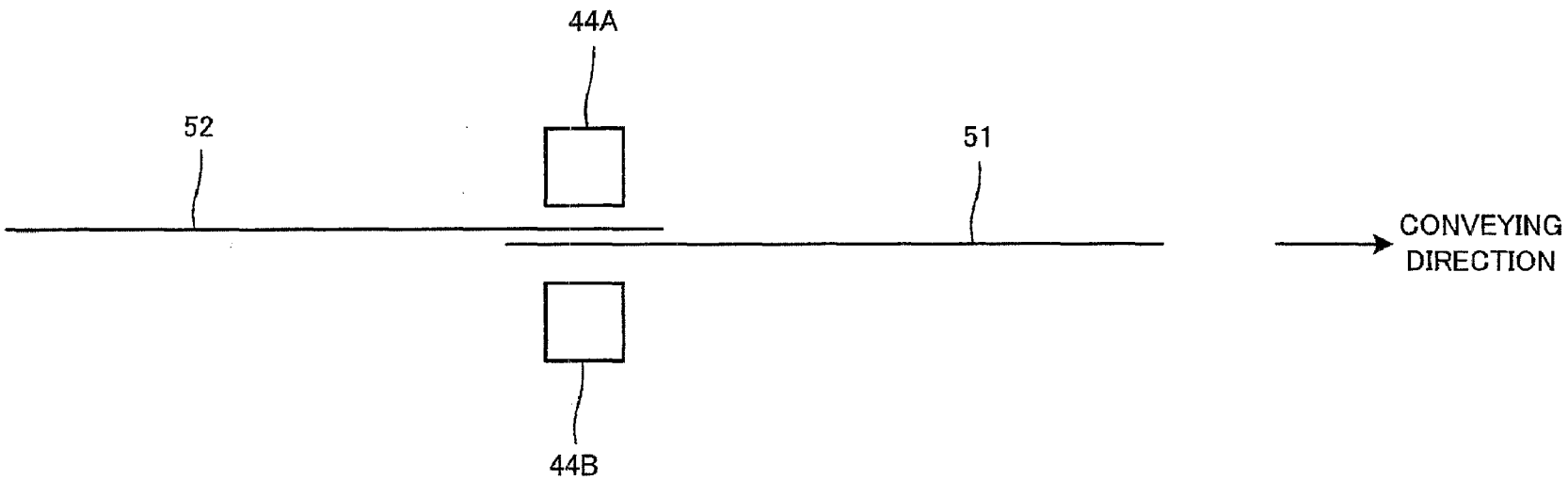
FIG. 2 is an explanatory diagram illustrating an overlapped feed.

FIG. 2 is an explanatory diagram conceptually illustrating a case in which two sheets 51 and 52 of the same type overlap (referred to as an "overlapped feed"). If two sheets overlap when the MFP 1 is measuring the length of sheets, the MFP 1 will measure the length from the leading edge of the first sheet 51 in the conveying direction to the trailing edge of the subsequent sheet 52. Hence, the length measured by the MFP 1 when sheets overlap is longer than the length measured when sheets do not overlap.

Here, the MFP 1 assumes that the first conveyed sheet does not overlap another sheet, measures the length of the first conveyed sheet, and sets the reference value to this length. Thereafter, if the length of subsequent sheets greatly deviates from this reference value, the MFP 1 determines that an overlapped feed has occurred. However, for the first conveyed sheet, the MFP 1 only measures the length of the sheet and does not perform overlapped-feed detection.

Figure 3:
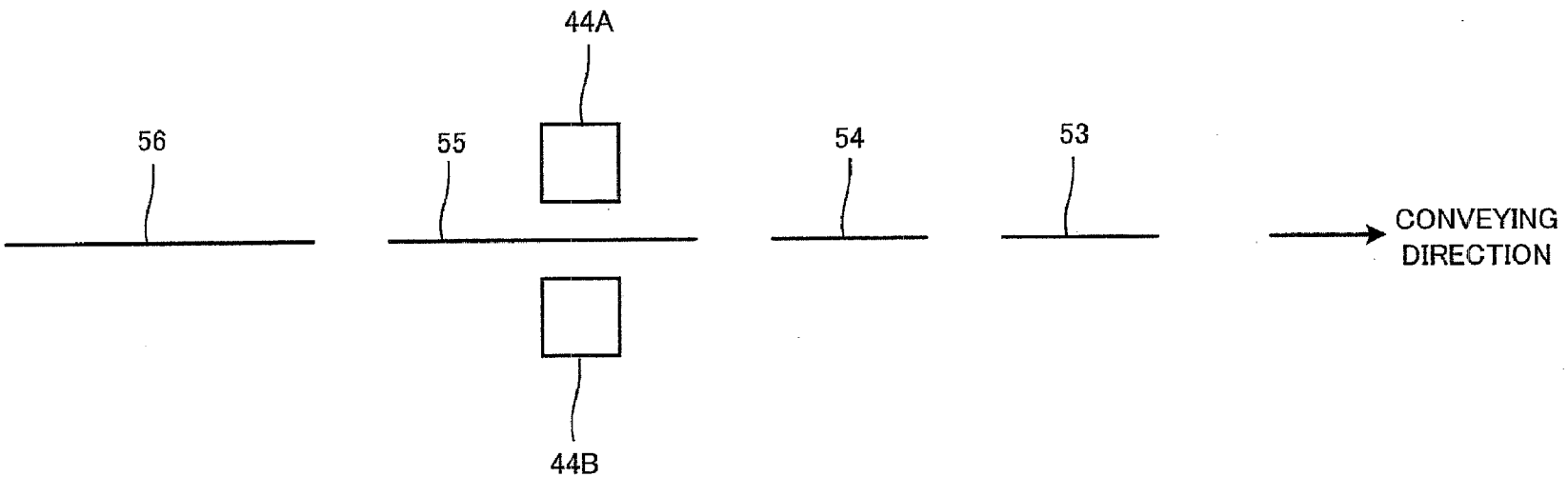
FIG. 3 is an explanatory diagram conceptually illustrating different types of sheets being conveyed along a conveying path.

(3) Overlapped-Feed Detection when a Plurality of Types of Sheets are Mixed in the Tray FIG. 3 is an explanatory diagram conceptually illustrating different types of sheets being conveyed along the conveying path 19 of the ADF 16. In this example, sheets 53 and 54 are of a first type, while sheets 55 and 56 are of a second type different from the first type. As shown in FIG. 3, when a plurality of types of sheets are mixed in the document tray 17, the type of sheet being conveyed on the conveying path changes.

In the conceivable case where the reference value for detecting an overlapped feed is not adjusted to suit the type of sheet when the length of the sheet differs according to the type, the MFP in this case will likely detect overlapped feeds by mistake. That is, in this case, since the MFP sets the reference value to the length of the initially conveyed sheet, which is the sheet 53 of the first type in this example, the MFP will correctly detect whether an overlapped feed has occurred when the subsequent sheet 54 of the same type is conveyed. However, the measured length for the sheets 55 and 56 of the subsequently conveyed second type will deviate greatly from the reference value, regardless of whether an overlapped feed occurs.

Therefore, the MFP 1 according to the embodiment determines whether the type of sheet being conveyed has changed. When the MFP 1 determines that the type has changed, the MFP 1 sets the reference value to the length of the first sheet conveyed after the sheet type has changed (the sheet 55 in the example of FIG. 3). In other words, the MFP 1 changes the reference value to correspond to the new type of sheet after detecting that the type has changed. Accordingly, the MFP 1 can compare the length of the next sheet 56 to the reference value set according to the second type of sheet. If an overlapped feed has not occurred, the discrepancy between the length of the sheet 56 and the reference value will be very small and the MFP 1 will not determine that an overlapped feed has occurred. Thus, this method reduces the likelihood of incorrect overlapped-feed detections. Here, the MFP 1 only measures the length of the sheet 55 and does not perform overlapped-feed detection since the sheet 55 is the first sheet conveyed after the type has changed.

In the embodiment, a change in the sheet type will be used to denote the beginning of sheet conveyance, as well as the timing in which the type of sheet to be conveyed next differs from the type of sheet just conveyed.

(4) Detecting a Change in Sheet Type

In the embodiment, each set of sheets of the same type that are grouped together in the document tray 17 is considered a single group, and the user specifies the number of sheets for each group except the group that is conveyed last. When the ADF 16 is conveying sheets, the MFP 1 increments a count value for conveyed sheets after each sheet is conveyed. When the count for conveyed sheets reaches the number specified for the group, the MFP 1 determines that a type change has occurred.

Next, the method of setting the number of sheets in each group will be described for examples in which a plurality of types of sheets is loaded in the document tray 17. In the first example, the user wishes to transmit a facsimile that includes an original document and an attached cover letter, while in the second example, the user wishes to copy an original document using instruction sheets.

Figure 4:
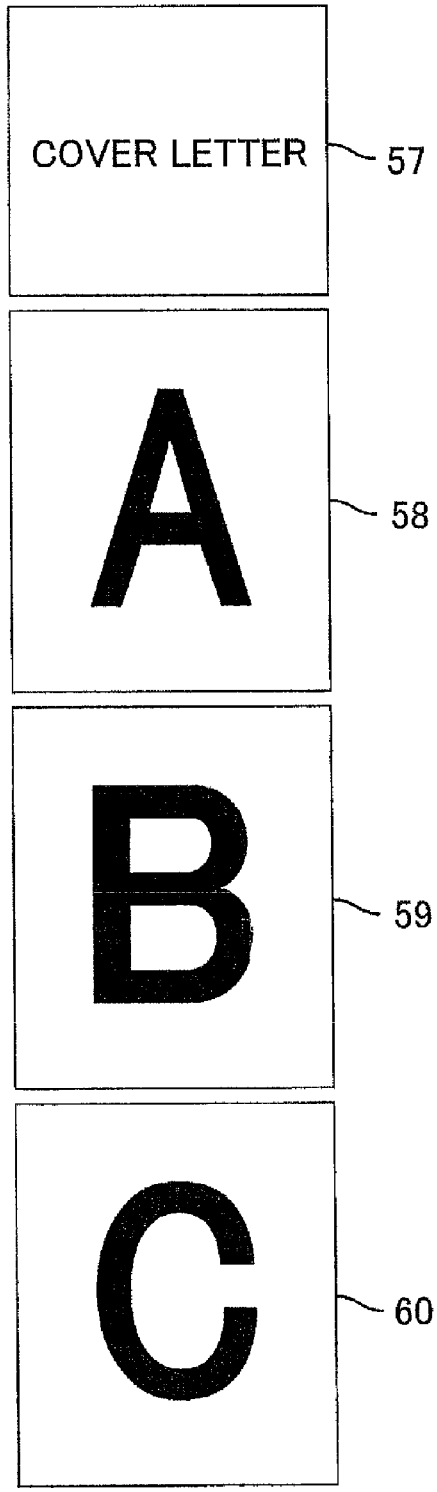
FIG. 4 is an explanatory diagram illustrating a transmission for setting the number of sheets when transmitting a facsimile of an original document with an attached cover letter.

(4-1) Transmitting a Facsimile Including an Original Document and an Attached Cover Letter FIG. 4 is an explanatory diagram for setting the number of sheets when transmitting a facsimile of an original document with an attached cover letter. In this example, the cover letter and the original document are types of sheet-like media. When transmitting a facsimile, ordinarily a cover letter 57 is added to the beginning of the original document (a three-page original 58-60 in this example). The type of sheet used for the cover letter 57 differs from the type of sheet used for the original 58-60. Therefore, when faxing an original document with an attached cover letter, the MFP 1 prompts the user to specify the number of sheets in each group, where the cover letter 57 is the initially conveyed group (hereinafter referred to as the "cover letter group") and the original 58-60 is the subsequently conveyed group (hereinafter referred to as the "original document group").

In the embodiment, the MFP 1 is provided with a plurality of reading modes defining a preset number of groups and a preset number of sheets in each group. One of these reading modes is the cover letter mode. When faxing an original document with a cover letter, the user can select, by using the operation unit, the cover letter mode to facilitate setting the number of sheets for each group.

Specifically, values for the cover letter mode have been preset in the ROM 38, including the value "2" for the number of groups, the value "1" for the number of sheets in the cover letter group, and a value meaning "indefinite" as the number of sheets in the original document group. When conveying the original document group, the MFP 1 need not detect a group change since the original document group is the last group to be conveyed. Accordingly, it is not necessary to set a number of sheets for the original document group. However, the MFP 1 according to the embodiment uses a prescribed value meaning "indefinite" to identify this group as the last group. Alternatively, the MFP 1 may be configured not to preset a value for the number of sheets in the original document group.

Figures 5, 6:
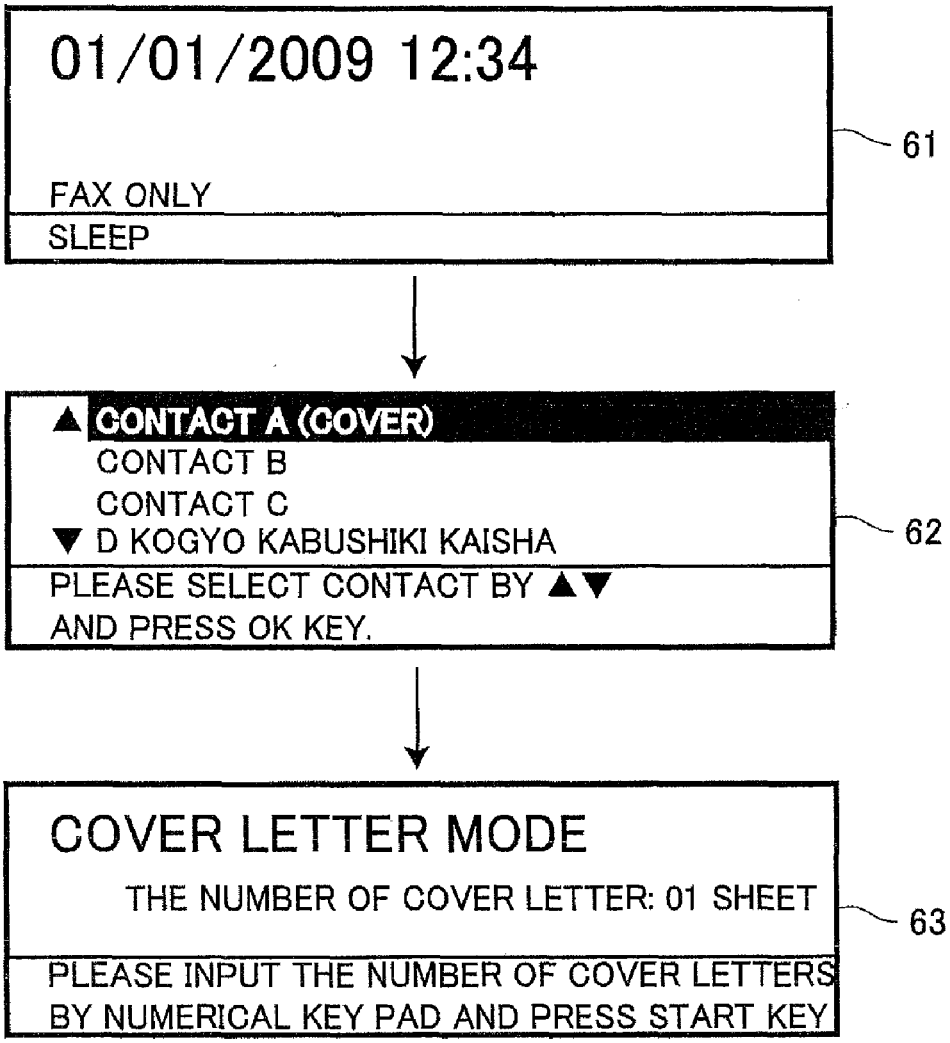
FIG. 5 is an explanatory diagram illustrating a user interface for setting the number of sheets in a cover letter group.
FIG. 6 is an explanatory diagram conceptually illustrating a table including the number of sheets for each group set through the user interface.

FIG. 5 is an explanatory diagram illustrating the user interface for setting the number of sheets in the cover letter group. By operating the operating unit 42 to select the facsimile function, the user displays an initial screen 61 shown in FIG. 5 on the LCD of the operating unit 42 for inputting settings for a facsimile transmission.

If the user presses a Select Telephone Number button (not shown) in the operating unit 42 while the initial screen 61 is displayed, a telephone number selection screen 62 is displayed as shown in FIG. 5. With the MFP 1 of the embodiment, the user can prerecord names in association with fax numbers (telephone numbers). Thus, when the telephone number selection screen 62 is displayed, the user can scroll through the prerecorded names recorded in the telephone number selection screen 62 by operating Up and Down buttons (not shown) on the operating unit 42 and can select a desired destination for the facsimile transmission by aligning the cursor with the desired contact and pressing an OK button (not shown) in the operating unit 42.

The character string "(COVER)" appended to the end of a contact name indicates a contact for which the user attaches a cover letter of a different type of sheet from the original document when transmitting a fax. Although the type of sheet used for the cover letter does not necessarily differ from the type of sheet used for the original document, for specific contacts, the size of the original document may be preset at "A4" (a document size regulated by a JIS standard), and the size of the cover letter at "A5", for example. The character string "(COVER)" identifies such specific contacts.

If the user selects a contact with the character string "(COVER)" appended after the name in the telephone number selection screen 62 and subsequently presses the OK button, the MFP 1 shifts to the cover letter mode and displays a cover letter page number input screen 63 for the cover letter mode. The number of sheets in the cover letter group is initially displayed in the cover letter page number input screen 63 as "1" ("01" in FIG. 5).

However, the user can modify this number to a desired number of sheets by operating the numerical buttons "0-9" (not shown) in the operating unit 42. When the user subsequently presses a Start button (not shown) in the operating unit 42, the MFP 1 sets the number of sheets for the cover letter group based on the number displayed in the cover letter page number input screen 63 at the time, and begins the scanning operation.

FIG. 6 is an explanatory diagram conceptually illustrating a table 71 including the number of sheets for each group set through the user interface described above. When the user presses the Start button (not shown) while the cover letter page number input screen 63 is displayed, the MFP 1 generates the table 71 associating each group number with the number of sheets in the corresponding group (a cover letter mode table) and stores the table 71 in the RAM 39, thereby setting the number of sheets for each group.

The number of sheets for Group 1 in the table 71 is the number of sheets in the initially conveyed group, that is, the number of sheets in the cover letter group in this example. This number is set to the number displayed in the cover letter page number input screen 63 when the Start button is pressed. The number of sheets in Group 2 in the table 71 is the number of sheets in the group conveyed after the first group, that is, the number of sheets in the original document group in this example. This number is set to "indefinite."

While the user modifies the number of sheets in the cover letter group by operating the numerical buttons "0-9" in the above example, this number of sheets may be adjusted according to the contact. For example, if the character string "(COVER)" has been appended to both Contact A and Contact B, the user may preregister the number "2" for the number of sheets in the cover letter for Contact A and "3" for the number of sheets for Contact B. Thereafter, when the user selects Contact A (COVER) in the telephone number selection screen 62, the initial value "2" is displayed as the number of sheets in the cover letter group in the cover letter page number input screen 63 instead of the initial value of "1" in the above example. When the user selects Contact B (COVER), the value "3" is displayed as the initial value.

(4-2) Copying an Original Using Instruction Sheets

Figure 7:
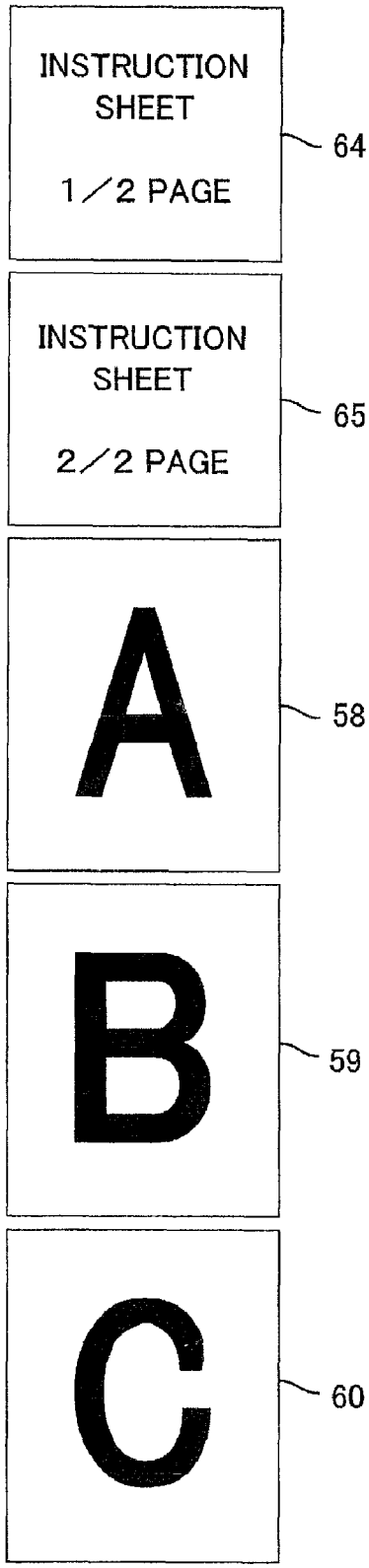
FIG. 7 is an explanatory diagram for illustrating how an original is copied using instruction sheets.

First, an overview of the process to copy an original using instruction sheets will be described. FIG. 7 is an explanatory diagram for illustrating how an original is copied using instruction sheets. FIG. 8 is an explanatory diagram with enlarged views of instruction sheets 64 and 65 shown in FIG. 7.

As shown in FIG. 8, the instruction sheets 64 and 65 provide various copy settings with a plurality of selectable values for each setting. For example, the setting "Document feed" specifies the method of feeding the original document being copied and can be set to one of the values "Flatbed," "ADF simplex," and "ADF duplex." The Flatbed setting indicates that an original document placed on the first platen glass 12 is to be scanned. The setting ADF simplex indicates that the reading unit 25 is to scan one surface of the original while the ADF 16 conveys the original one sheet at a time from the document tray 17. ADF duplex is a similar method, but the reading unit 25 scans both sides of the original. A detailed description of the other settings will not be included herein.

The user selects desired options by filling in the boxes positioned on the left of the desired settings in the instruction sheets 64 and 65 with a pencil or the like. After making all the desired settings, the user places the instruction sheets 64 and 65 and the original 58-60 in this order to be scanned on the document tray 17 and presses the Start button.

When the Start button is pressed, the MFP 1 initially scans the instruction sheets 64 and 65 and generates image data. Next, the MFP 1 performs image recognition on the generated image data to determine which settings have been selected, and subsequently copies the original 58-60 based on the selected settings.

When using these instruction sheets to specify settings for copying an original, one or more instruction sheets are added to the top of the original, as described above. In some cases, the instruction sheets may be formed of a different type of sheet than the original being copied. Therefore, when copying an original using instruction sheets, the user is prompted to enter the number of sheets in the group of instruction sheets that is conveyed first (hereinafter referred to as the "instruction sheet group") and the number of sheets in the group of original documents conveyed thereafter (the "original document group").

More specifically, values are prestored in the ROM 38 for an instruction sheet mode, which is the mode for copying an original using instruction sheets, and include the value "2" for the number of groups, the value "2" for the number of sheets in the instruction sheet group, and a value meaning "indefinite" for the number of sheets in the original document group. As in the previous example, the number of sheets in the original document group may also be left unspecified.

Figures 9, 10, 11:
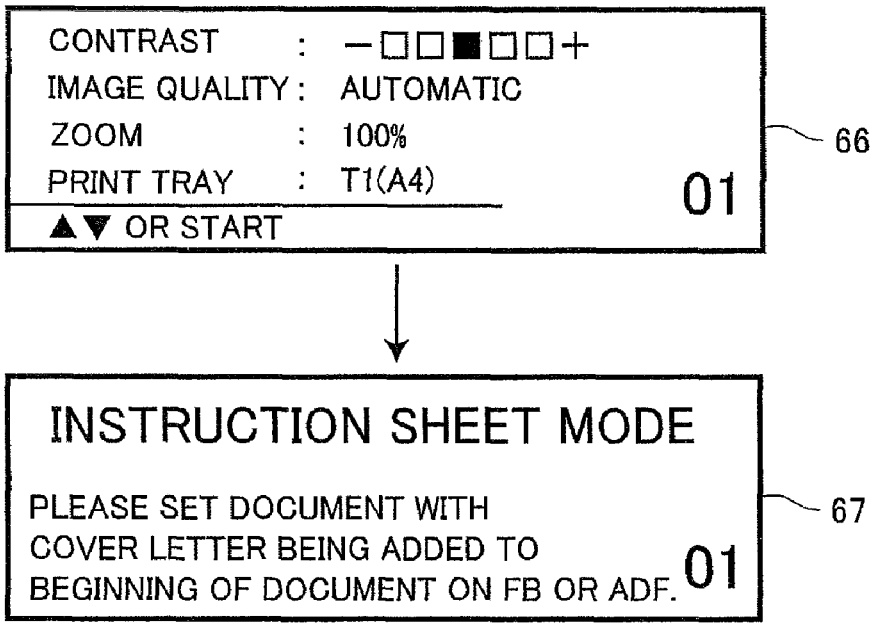
FIG. 9 is an explanatory diagram illustrating the user interface for copying an original using instruction sheets.
FIG. 10 is an explanatory diagram conceptually illustrating a table including the number of sheets for each group set according to the user interface.
FIG. 11 conceptually illustrates a table for a normal mode.

FIG. 9 is an explanatory diagram illustrating the user interface (the LCD of the operating unit 42) for copying an original using instruction sheets. A copy settings screen 66 that enables the user to choose copy settings is displayed when the user selects the copy function through an operation of the operating unit 42. The number "01" displayed in the copy settings screen 66 indicates the number of copies. This number indicates the number of copies to be formed for each sheet of the original and does not specify the number of sheets in the group. By performing copy settings in the copy settings screen 66 and subsequently pressing the Start button, the user can copy an original without using instruction sheets. If the user presses the Start button while the copy settings screen 66 is displayed, the MFP 1 does not perform image recognition of instruction sheets.

If the user performs a prescribed operation for switching to the instruction sheet mode while the copy settings screen 66 is displayed, the MFP 1 enters the instruction sheet mode and displays an instruction sheet mode screen 67 shown in FIG. 9. When the user presses the Start button while the instruction sheet mode screen 67 is displayed, the MFP 1 sets the number of sheets for each group and begins scanning.

FIG. 10 is an explanatory diagram conceptually illustrating a table 72 including the number of sheets for each group set according to the user interface described above. When the user presses the Start button while the instruction sheet mode screen 67 is displayed, the MFP 1 generates the table 72 associating the number of each group with the number of sheets in that group (hereinafter referred to as the "instruction sheet mode table") and stores this table in the RAM 39, thereby setting the number of sheets for each group.

In the table 72 shown in FIG. 10, the number of sheets in document group 1 indicates the number of sheets in the group initially conveyed, i.e., the instruction sheet group. This number is set to "2" in the embodiment. The number of sheets in document group 2 specifies the number of sheets in the group subsequently conveyed, i.e., the original document group. This number is set to "indefinite" in the embodiment.

(4-3) Not Determining Changes in the Sheet Type

There are also cases in which the user may not be performing a facsimile transmission in the cover letter mode or a copy operation in the instruction sheet mode, even though the sheets set in the document tray 17 include a mixture of different types. In such cases, there is a danger that the MFP 1 will not detect changes in groups, leading to incorrect overlapped-feed detections. Therefore, the user can select the mixed mode through operations on the operating unit 42 for such cases.

For example, to transmit a fax for a mixture of sheets of various types in the document tray 17 without selecting the cover letter mode, the user selects a desired contact in the telephone number selection screen 62 to which the character string "(COVER)" has not been appended. Next, the user specifies the mixed mode through an operation on the operating unit 42 and presses the Start button.

Further, to copy a mixture of sheets of various types in the document tray 17 without selecting the instruction sheet mode, the user selects the mixed mode through an operation on the operating unit 42 while the copy settings screen 66 is displayed and subsequently presses the Start button.

When the user has selected the mixed mode and pressed the Start button, the MFP 1 begins scanning the original without detecting overlapped feed. Hence, the MFP 1 also does not determine whether groups have changed.

If none of the cover letter mode, instruction sheet mode, and mixed mode has been selected when the Start button is pressed, the MFP 1 assumes that only sheets of the same type are set in the document tray 17 and automatically selects a normal mode. In the normal mode, all sheets belong to a single group (original document group). For the normal mode, the value "1" is preset as the number of groups, and a value meaning "indefinite" is preset as the number of sheets in the original document group in the ROM 38.

FIG. 11 conceptually illustrates a table 73 for the normal mode. The normal mode table 73 is generated and stored in the RAM 39 when the normal mode is selected, thereby setting the number of sheets for each group.

Since the initially conveyed group (the original document group) is also the group conveyed last in the normal mode, there is no need to determine whether groups have changed. Therefore, the MFP 1 performs overlapped-feed detection in the normal mode but does not determine whether groups have changed.

(5) Scanning Process

Next, a scanning process for scanning an original document will be described. This process will be described for cases in which scanning begins after the user performs one of the operations in 1) through 4).

1) The user selects a contact in the telephone number selection screen 62 having the appended character string "(COVER)," placing the MFP 1 in the cover letter mode, and presses the Start button while the cover letter page number input screen 63 is displayed (scanning in the cover letter mode).

2) The user performs a prescribed operation while the copy settings screen 66 is displayed, placing the MFP 1 in the instruction sheet mode, and presses the Start button while the instruction sheet mode screen 67 is displayed (scanning in the instruction sheet mode).

3) The user selects a contact in the telephone number selection screen 62 not having the appended character string "(COVER)," sets the mixed mode, and presses the Start button; or selects the mixed mode while the copy settings screen 66 is displayed and presses the Start button (scanning in the mixed mode).

4) The user presses the Start button without having selected one of the cover letter mode, instruction sheet mode, and mixed mode. That is, the MFP 1 performs the scanning in the normal mode. More specifically, the user selects a contact in the telephone number selection screen 62 not having the appended character string "(COVER)" and presses the Start button without specifying the mixed button; or presses the Start button while the copy settings screen 66 is displayed without specifying the mixed mode.

(5-1) Overview of the Scanning Process

Figure 12:
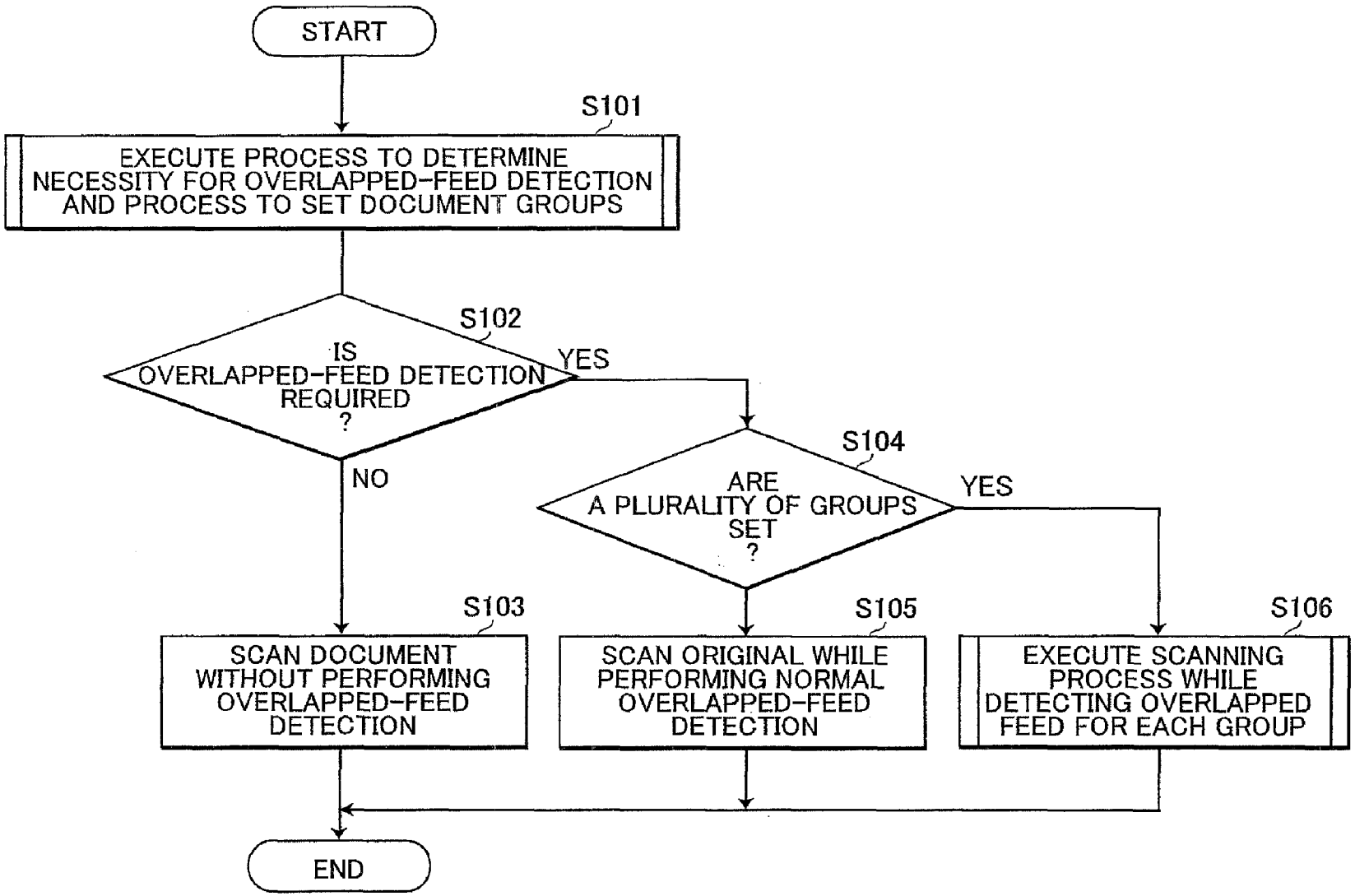
FIG. 12 is a flowchart illustrating steps in an overall scanning process.

FIG. 12 is a flowchart illustrating steps in the overall scanning process. In the following description "document" will include the cover letter or instruction sheet.

In S101 the CPU 37 of the MFP 1 executes a process to determine the necessity for overlapped-feed detection and, when determining that overlapped-feed detection is necessary, to set document groups. While this process will be described later in greater detail, the MFP 1 determines that overlapped-feed detection is necessary when the MFP 1 has been set to the cover letter mode, the instruction sheet mode, or the normal mode and determines that overlapped-feed detection is unnecessary when the MFP 1 is set to the mixed mode.

In S102 the CPU 37 determines whether overlapped-feed detection is required based on the results of the process performed in S101. The CPU 37 advances to S103 if overlapped-feed detection is not required (the mixed mode). The CPU 37 advances to S104 if overlapped-feed detection is required (the cover letter mode, instruction sheet mode, or normal mode).

In S103 the CPU 37 scans the document without performing overlapped-feed detection. In S104 the CPU 37 determines whether a plurality of groups are set in the process of S101 described above. Here, the number of groups will be plural for the cover letter mode and the instruction sheet mode and singular for the normal mode. The CPU 37 advances to S105 when determining that the number of groups is singular, i.e., when the MFP 1 is set to the normal mode (S104: NO). The CPU 37 advances to S106 when determining that the number of groups is plural, i.e., when the MFP 1 is set to the cover letter mode or the instruction sheet mode (S104: YES).

In S105 the CPU 37 scans the original while performing normal overlapped-feed detection. "Normal overlapped-feed detection" is a process for detecting overlapped feed without determining whether the document group being conveyed has changed. In S106 the CPU 37 executes a scanning process while detecting overlapped feeds for each group.

Through the process described above, the CPU 37 scans the original document to generate image data. The facsimile transceiver 40 of the MFP 1 transmits this image data by fax when the facsimile function has been selected, and the printing unit 41 prints this image data when the copy function has been selected.

Figure 13:
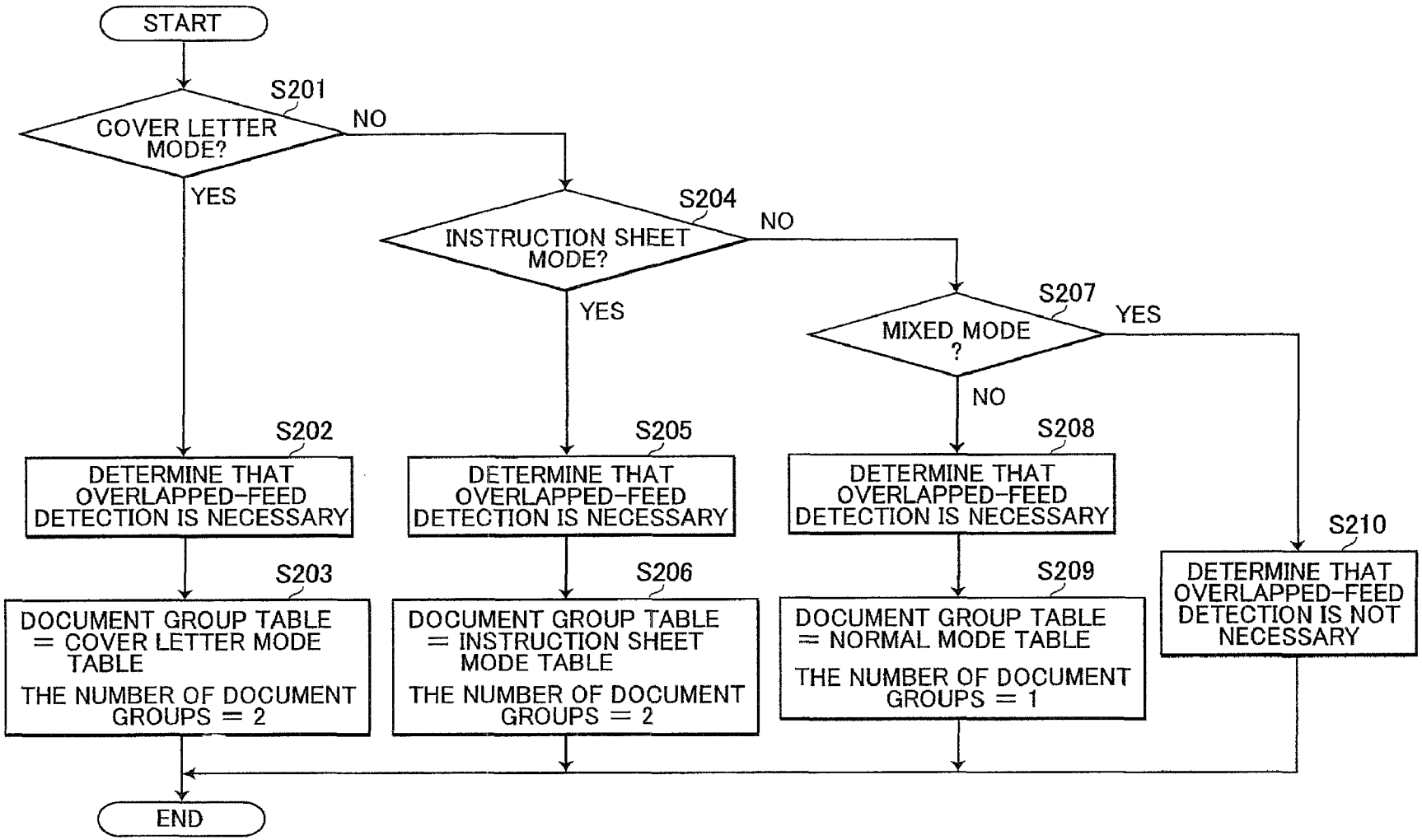
FIG. 13 is a flowchart illustrating steps in a process to determine a necessity for overlapped-feed detection and to set groups.

(5-2) Process to Determine the Necessity for Overlapped-Feed Detection and to Set Groups FIG. 13 is a flowchart illustrating steps in the process to determine the necessity for overlapped-feed detection and to set groups. In S201 of this process, the CPU 37 determines whether the MFP 1 is in the cover letter mode. The CPU 37 advances to S202 when the MFP 1 is in the cover letter mode (S201: YES). The CPU 37 advances to S204 when the MFP is not in the cover letter mode (S201: NO).

In S202 the CPU 37 determines that overlapped-feed detection is necessary. In S203 the CPU 37 sets the document group table to the cover letter mode table and sets the number of document groups to "2", which is the number of groups in the cover letter mode. In S204 the CPU 37 determines whether the MFP 1 is in the instruction sheet mode. The CPU 37 advances to S205 when the MFP 1 is in the instruction sheet mode (S204: YES). The CPU 37 advances to S207 when the MFP 1 is not in the instruction sheet mode (S204: NO).

In S205 the CPU 37 determines that overlapped-feed detection is necessary. In S206 the CPU 37 sets the document group table to the instruction sheet mode table and sets the number of document groups to "2", which is the number of groups in the instruction sheet mode.

In S207 the CPU 37 determines whether the MFP 1 is in the mixed mode. The CPU 37 advances to S208 when the MFP 1 is not in the mixed mode (when the MFP 1 is in the normal mode; S207: NO). The CPU 37 advances to S210 when the MFP 1 is in the mixed mode (S207: YES).

In S208 the CPU 37 determines that overlapped-feed detection is necessary. In S209 the CPU 37 sets the document group table to the normal mode table and sets the number of document groups to "1", which is the number of groups in the normal mode.

In S210 the CPU 37 determines that overlapped-feed detection is not necessary.

(5-3) Process for Scanning while Detecting Overlapped Feeds for Each Group

Figure 14:
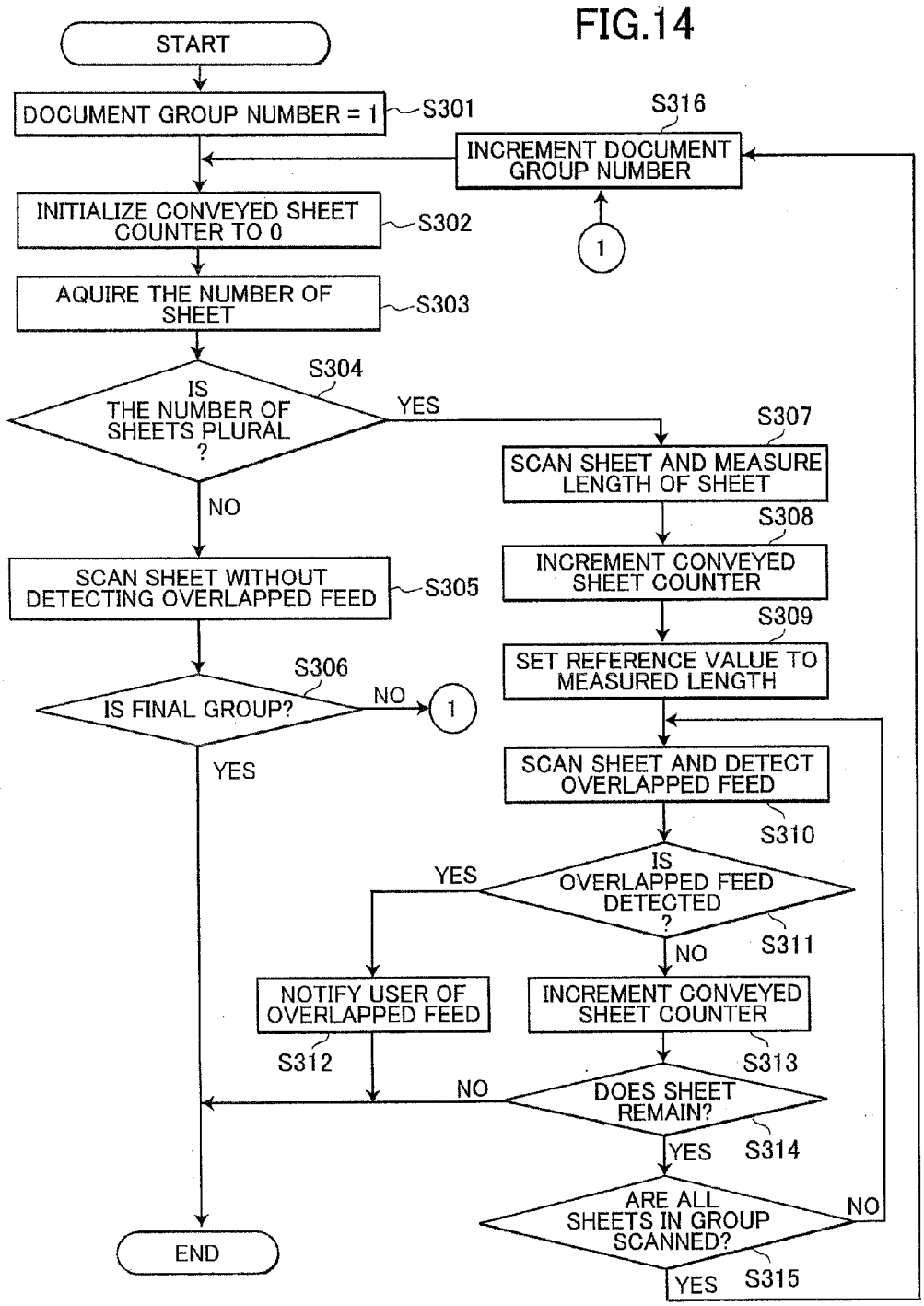
FIG. 14 is a flowchart illustrating steps in a process for scanning while detecting overlapped feeds for each group.

FIG. 14 is a flowchart illustrating steps in the process for scanning while detecting overlapped feeds for each group. In S301 of the process in FIG. 14, the CPU 37 initializes a variable Document Group Number to "1", where Document Group Number indicates the group currently targeted for processing.

In S302 the CPU 37 initializes a variable Conveyed Sheet Counter to "0", where Conveyed Sheet Counter indicates the number of sheets that have already been conveyed. In S303 the CPU 37 acquires the number of sheets for the group having the number corresponding to the Document Group Number from the document group table. In S304 the CPU 37 determines whether the number of sheets acquired in S303 is plural. The CPU 37 advances to S305 when the number of sheets is not plural (S304: NO), i.e., one sheet. The CPU 37 advances to S307 when the number is plural (S304: YES).

In S305 the CPU 37 scans the single sheet of the original without detecting overlapped feed. In S306 the CPU 37 determines whether the group having the number set as the Document Group Number is the final group. The CPU 37 ends the current process if the group is the final group (S306: YES). The CPU 37 advances to S316 if the group is not the final group (S306: NO).

In S307 the CPU 37 controls the ADF 16 to feed the first sheet of the current group and controls the reading unit 25 to scan the sheet. At the same time, the CPU 37 controls the photoelectric sensor 44 to measure the length of the sheet. In S308 the CPU 37 increments the Conveyed Sheet Counter by 1.

In S309 the CPU 37 sets the reference value to the length measured in S307. Here, the CPU 37 may set the reference value to the length measured in S307 or to a range including ±10% of the measured length, for example. Since even sheets of the same type may have slight variations in length, setting the reference value to a range can increase the reliability in detecting overlapped feeds.

In S310 the CPU 37 controls the ADF 16 to convey the next sheet of the group and controls the reading unit 25 to scan the sheet. At the same time, the CPU 37 controls the photoelectric sensor 44 to measure the length of the sheet being conveyed and compares this measured length to the reference value set in S309 to determine whether an overlapped feed has occurred. More specifically, if the reference value is set as a range, the CPU 37 determines that an overlapped feed has not occurred if the measured length falls within this range and determines that an overlapped feed has occurred if the length does not fall within this range.

In S311 the CPU 37 determines whether an overlapped feed is detected in S310. The CPU 37 advances to S312 if an overlapped feed is detected (S310: YES). The CPU 37 advances to S313 if an overlapped feed was not detected (S310: NO).

In S312 the CPU 37 notifies the user that an overlapped feed was detected and subsequently ends the scanning operation. The CPU 37 may notify the user of an overlapped feed by displaying a message in the LCD indicating that an overlapped feed was detected, playing an audio message, or according to another method.

In S313 the CPU 37 increments the Conveyed Sheet Counter by 1. In S314 the CPU 37 determines whether there remain any sheets of the original document to be scanned. If there are no remaining sheets to be scanned (S314: NO), the CPU 37 determines that all sheets of the original document have been scanned and ends the current process. However, if there remain sheets to be scanned (S314: YES), the CPU 37 advances to S315. Here, the CPU 37 may determine that there are no more sheets of the original left to be scanned if the level of the electric signal outputted from the photoelectric sensor 44 does not change from high (bright) to low (dark) within a prescribed time, for example.

In S315 the CPU 37 determines whether a number of sheets of the original document equivalent to the number of sheets in the group corresponding to the Document Group Number acquired in S303 has been scanned. If a number of sheets equivalent to the number in the current group has been scanned (S315: YES), the CPU 37 determines that the group has changed, i.e., that the type of sheet has changed, and advances to S316. If the number of sheets is not equivalent to the number in the current group (S315: NO), then the CPU 37 returns to S310 and repeats the above process until a number of sheets equivalent to the number in the current group has been scanned.

The process in S314 described above for determining whether there remain sheets of the original to scan is necessary for the case in which the number of sheets in a group is specified as "indefinite" because the CPU 37 may never reach a YES determination in S315 regarding whether the number of sheets in the group has been read and, thus, will never detect the end of the group. When the number of sheets in the group is specified as "indefinite," the CPU 37 continues until all remaining sheets of the original have been scanned. Once all sheets of the document have been scanned, the CPU 37 determines that there are no more groups to scan and ends the scanning process.

In S316 the CPU 37 increments the Document Group Number by 1 and returns to S302.

In the process described above, the CPU 37 advances to S316 upon determining in S315 that a number of sheets equivalent to the number in the group have been scanned, after which in S309 the CPU 37 sets the reference value to the length of the first sheet conveyed in the next group, thereby modifying the reference value to suit the type of sheet following a change in groups.

(6) Effects of the Embodiment

According to the embodiment, the MFP 1 determines whether the type of sheet being conveyed has changed and sets the reference value according to the length of the sheet conveyed after the sheet type has changed. Accordingly, the MFP 1 can detect overlapped feeds with accuracy, even when a mixture of sheets of different types has been set in the document tray 17.

Further, the MFP 1 measures the length of the sheet. The length measured by the MFP 1 when sheets overlap is longer than the length measured when sheets do not overlap. Accordingly, the MFP 1 can detect overlapped feeds by measuring the length of the sheet.

The MFP 1 sets the reference value to the length of the first sheet conveyed after the sheet type has changed. The MFP 1 can modify the reference value to suit the type of sheet after the type has changed.

In the embodiment, each set of sheets of the same type that are grouped together in the document tray 17 is considered a single group, and the user specifies the number of sheets for each group except the group that is conveyed last. When the ADF 16 is conveying sheets, the MFP 1 increments a count value of the Conveyed Sheet Counter after each sheet is conveyed. The MFP 1 can determine that a type change has occurred based on the specified number of sheets and the number of conveyed sheets.

The MFP 1 has the ADF 16 and the reading unit 25. The ADF 16 conveys each of mixed documents and passes each of the documents on the document tray 17 toward the position to be read. The reading unit 25 generates the image data from the document passing the position. Accordingly, the MFP 1 can detect overlapped feeds of the documents conveyed by the ADF 16.

With the MFP 1 according to the embodiment, the user can select one of a plurality of scanning modes having a preset number of groups and a preset number of sheets for each group. Thus, the user can easily set the number of sheets for each group by combining (mixing) sheets of different types in the document tray 17 that conform to the number of groups and number of sheets in each group preset for a selectable scanning mode and by subsequently selecting the scanning mode.

For example, the MFP 1 has a cover letter mode for transmitting an original with an attached cover letter of a different type of sheet from the original that specifies the cover letter as one group and the original as a separate group. Accordingly, the user can easily set the number of sheets for each group when transmitting image data.

Further, with the MFP 1 according to the embodiment, the user can modify the number of sheets in the cover letter group that is set in the cover letter mode because the number of sheets in a cover letter is not necessary fixed and may vary from time to time. Thus, the MFP 1 of the embodiment is more user-friendly by allowing the user to adjust the number of sheets in the cover letter group.

Further, the MFP 1 according to the embodiment allows the user to select a contact, and modifies the number of sheets in the cover letter group according to the selected contact. Thus, if the number of sheets in a cover letter varies among a plurality of contacts, the MFP 1 modifies the number of sheets in the cover letter based on the selected contact, making the settings more user-friendly for transmitting image data with an attached cover letter.

Second Embodiment

Figure 15:
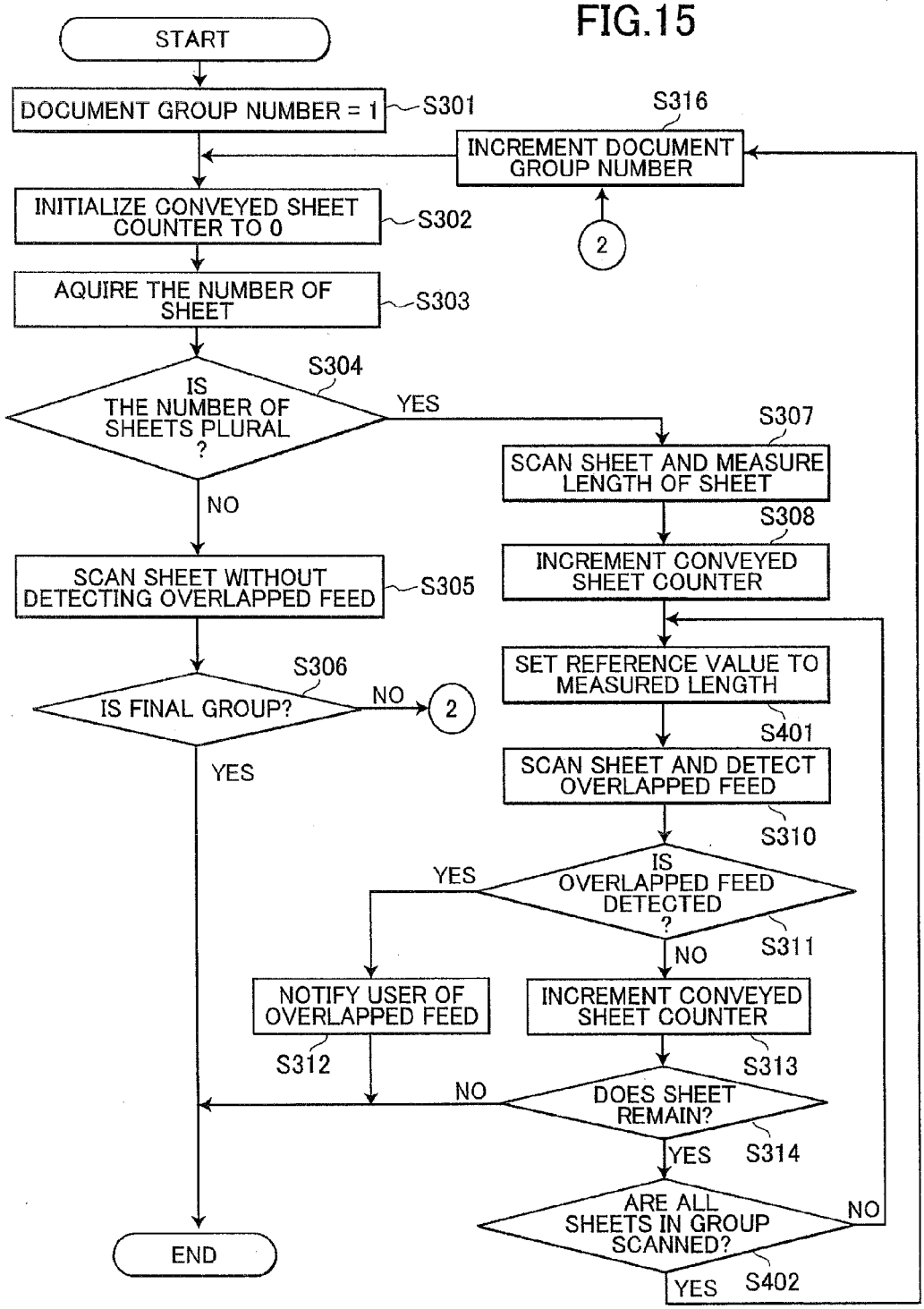
FIG. 15 is a flowchart illustrating steps in a process for scanning while detecting overlapped feeds in each group according to a second embodiment.

Next, a second embodiment of the invention will be described with reference to FIG. 15. In the second embodiment, the CPU 37 updates the reference value to the length of the last sheet measured for each sheet in the group. FIG. 15 is a flowchart illustrating steps in a process according to the second embodiment for scanning while detecting overlapped feeds in each group, where steps to those described in FIG. 14 of the first embodiment have been designated with the same step numbers to avoid duplicating description.

In S401 the CPU 37 sets the reference value to the last length measured. Specifically, if the current sheet is the first sheet of a group, the CPU 37 sets the reference value to the length measured in S307. When the current sheet is the second or subsequent sheet of a group, the CPU 37 sets the reference value to the length measured in S310. In other words, if a type of a subject sheet is the same as a type of the sheet conveyed immediately before the subject sheet, the CPU 37 changes the reference value to a quantity with respect to the sheet conveyed immediately before the subject sheet.

When the CPU 37 determines in S402 that a number of sheets equivalent to the number in the current group has been scanned (S402: YES), the CPU 37 advances to S316. If a number of sheets equivalent to the number in the group has not been scanned (S402: NO), the CPU 37 returns to S401 and repeats the above process until a number of sheets equivalent to the number in the current group has been scanned.

As described above, the MFP 1 according to the second embodiment updates the reference value to the length of the sheet last measured by the photoelectric sensor 44 after each time the photoelectric sensor 44 measures the length of a sheet. This is performed because the measuring precision of the photoelectric sensor 44 can vary over time. If the measuring precision of the photoelectric sensor 44 varies over time, the MFP 1 may calculate a larger discrepancy between the reference value and the measured value and incorrectly determine that an overlapped feed has occurred, even when that is not the case. By configuring the MFP 1 to update the reference value to the most recently measured length each time the photoelectric sensor 44 measures the length of a sheet, it is possible to reduce the amount of time that elapses between when setting the reference value and when measuring the length of the next sheet. As a result, the amount of difference between the reference value and the length of the next conveyed sheet when an overlapped feed has not occurred is less, reducing the chance of an incorrect overlapped-feed detection.

In all other respects, the MFP 1 according to the second embodiment is essentially identical to the MFP 1 according to the first embodiment.

Third Embodiment

Next, a third embodiment of the invention will be described. In the third embodiment, a value set as the reference value is stored in the ROM 38 for each type of sheet. When the type of sheet being conveyed changes in a scanning operation, the MFP 1 reads a value from the ROM 38 corresponding to the type of the first sheet conveyed after the change and sets the reference value to this value.

In the case of the instruction sheet mode, for example, if a specific type of sheet is always used as the instruction sheet, this sheet type can be set in the instruction sheet group, although the user would be able to modify the sheet type set to the instruction sheet group as needed.

Further, reference values associated with each sheet type are stored separately in the ROM 38. Upon determining a change in group, the MFP 1 acquires the type of group to be conveyed after the change from the document group table, reads the value associated with this sheet type from the ROM 38, and sets the reference value to this value.

According to the third embodiment described above, the MFP 1 can modify the reference value based on the type of sheet conveyed after a change, enabling the MFP 1 to detect an overlapped feed for the sheet conveyed after the sheet type has changed.

While values to be set as reference values are stored in the ROM 38 in the above example, these values may be stored in a nonvolatile storage device, such as Flash Memory. Further, the user may be allowed to modify the values through operations on the operating unit 42. With this ability, the user can adjust the reference values based on the measuring accuracy of the photoelectric sensor 44 when this measuring accuracy changes over time, thereby enabling the MFP 1 to detect overlapped feeds with greater accuracy.

In all other respects, the MFP 1 according to the third embodiment is essentially identical to the MFP 1 according to the first embodiment.

Fourth Embodiment

Next, a fourth embodiment of the invention will be described. In the fourth embodiment, the MFP 1 measures the thickness of sheets as the specific quantity that differs between when an overlapped feed occurs and when an overlapped feed does not occur. In the event of an overlapped feed, portions of two sheets overlap each other, for example, and the overlapped portion is thicker than a single sheet. In other words, the measured thickness when sheets are overlapped is greater than the measured thickness when sheets are not overlapped. Accordingly, overlapped feeds can be detected by measuring the thickness of the conveyed sheets.

However, in a conceivable case where the reference value for detecting an overlapped feed is not changed according to the type of sheet when the thickness of the sheet varies according to the type, the MFP will likely detect overlapped feeds by mistake. According to the fourth embodiment, when measuring the thickness of the sheet as the measured quantity, the MFP 1 determines when the type of sheet being conveyed has changed. When the type of sheet changes, the MFP 1 modifies the reference value to suit the new sheet type. In this way, the MFP 1 can detect overlapped feeds with accuracy, even when a mixture of sheets including a plurality of types is set in the document tray 17.

The MFP 1 may measure the thickness of sheets by directly measuring the distance from one surface of the sheet to the other, or may indirectly measure the thickness by measuring the intensity of transmitted light when the different types of sheets are formed of the same material. The photoelectric sensor 44 can be used for measuring the intensity of transmitted light. In this case, since there is no need to provide a separate device for measuring thickness when using the photoelectric sensor 44 for this purpose, the thickness can be measured without increasing the number of parts in the MFP 1.

Further, using the photoelectric sensor 44 in combination with the second embodiment can reduce error in thickness measurements due to changes over time in the intensity of light detected by the photoelectric sensor 44, thereby improving the precision in which the MFP 1 can detect overlapped feeds.

In all other respects, the MFP 1 according to the fourth embodiment is essentially identical to the MFP 1 according to the first embodiment.

<Modifications>

While the invention has been described in detail with reference to the embodiments thereof, it would be apparent to those skilled in the art that various changes and modifications may be made therein without departing from the spirit of the invention.

(1) While the embodiments describe cases in which one or two types of sheets are set in the document tray 17, the invention may be applied to cases in which three or more types of sheets are combined (mixed). In this case, scanning modes for handling three or more types of sheets may be prepared for the MFP 1. Alternatively, the user may be allowed to freely set the number of groups and the number of sheets in each group through operations on the operating unit 42, without regard for the number of types of sheets.

(2) The embodiments described above give examples of the length and thickness of sheets being the measured quantity, but another measured quantity may be used, provided that the measured result of this quantity differs between cases in which overlapped feeds occur and cases in which overlapped feeds do not occur.

(3) While a multifunction peripheral is described as an example of the image-reading device in the embodiments, the invention may be applied to an image scanner possessing only a scanning function, a facsimile device possessing only a facsimile function, and the like.

(4) While the document cover 15 serves as an example of the sheet-medium-conveying device in the embodiments, the sheet-medium-conveying device may be employed in a printer that forms images on a recording medium such as paper while the recording medium is conveyed one sheet at a time from a paper tray and may detect overlapped feeds occurring among the recording medium conveyed along the conveying path. The sheet-medium-conveying device of the invention may be applied to any device that conveys a plurality of types of sheets one sheet at a time, in which device it is desirable to detect overlapped feeds.

(5) The image sensor control unit 35, the image-processing unit 36, the CPU 37, the ROM 38, the RAM 39, the facsimile transceiver 40, the printing unit 41, the operating unit 42, and the interface unit 43 may be provided in the document cover 15.

What is claimed is:

1. A sheet-medium-conveying device comprising:
- a tray on which a plurality of sheets are settable;
- a conveying unit that conveys the sheets on the tray;
- a measuring unit that measures a quantity with respect to the sheet conveyed by the conveying unit;
- a detecting unit that detects an overlapped feed in which at least two sheets are conveyed in a partially overlapped condition, the overlapped feed being detected by comparing the quantity measured by the measuring unit with a reference value;
- a determining unit that is configured to automatically determine whether a type of sheet conveyed by the conveying unit is changed; and
- a reference value changing unit that is configured to change the reference value to a value corresponding to the changed type of sheet as automatically determined by the determining unit.

2. The sheet-medium-conveying device according to claim 1, wherein the quantity measured by the measuring unit is a length of the sheet.

3. The sheet-medium-conveying device according to claim 1, wherein the quantity measured by the measuring unit is a thickness of the sheet.

4. The sheet-medium-conveying device according to claim 1, wherein the reference value changing unit sets a quantity measured by the measuring unit as the reference value with respect to a sheet that is firstly conveyed when the determining unit automatically determines that the type of sheets is changed.

5. The sheet-medium-conveying device according to claim 1, further comprising a memory that stores a plurality of values associated with a plurality of types of sheets,
- wherein the reference value changing unit reads, from the memory, a value corresponding to the changed type of sheet and changes the reference value to the read value.

6. The sheet-medium-conveying device according to claim 5, further comprising an operating unit,
- wherein the plurality of values stored in the memory is rewritebale through an operation by the operating unit.

7. The sheet-medium-conveying device according to claim 1, wherein if a type of a subject sheet is the same as a type of the sheet conveyed immediately before the subject sheet, the reference value changing unit changes the reference value to a quantity measured by the measuring unit with respect to the sheet conveyed immediately before the subject sheet, the measuring unit measuring a quantity with respect to each sheet conveyed by the conveying unit.

8. The sheet-medium-conveying device according to claim 1, further comprising:
- a setting unit that sets a number of sheets for each type of the sheets on the tray except a type that is finally conveyed by the conveying unit; and
- a counting unit that counts a number of sheets that has been conveyed by the conveying unit,
- wherein the determining unit automatically determines whether the type of sheets conveyed by the conveying unit is changed based on the number of sheets set by the setting unit and the number of sheets counted by the counting unit.

9. An image-reading device comprising:
- a tray on which a plurality of sheets are settable;
- a conveying unit that conveys the sheets on the tray;
- a reading unit that reads an image of the sheet conveyed by the conveying unit and generates image data;
- a measuring unit that measures a quantity with respect to the sheet conveyed by the conveying unit;
- a detecting unit that detects an overlapped feed in which at least two sheets are conveyed in a partially overlapped condition, the overlapped feed being detected by comparing the quantity measured by the measuring unit with a reference value;
- a determining unit that is configured to automatically determine whether a type of sheet conveyed by the conveying unit is changed; and
- a reference value changing unit that is configured to change the reference value to a value corresponding to the changed type of sheet as automatically determined by the determining unit.

10. The image-reading device according to claim 9, further comprising:
- a setting unit that sets a number of sheets for each type of the sheets on the document tray except a type that is finally conveyed by the conveying unit; and
- a counting unit that counts a number of sheets that has been conveyed by the conveying unit,
- wherein the determining unit automatically determines whether the type of sheets that conveyed by the conveying unit is changed based on the number of sheets sets by the setting unit and the number of sheets counted by the counting unit.

11. The image-reading device according to claim 10, further comprising:
- a memory that stores settings of a plurality of reading modes that set a number of types of sheets and a number of sheets for each of the types of sheets; and
- a selecting unit that selects a reading mode among the plurality of reading modes.

12. The image-reading device according to claim 11, further comprising a number changing unit that changes the number of sheets and the number of types of sheets stored in the memory.

13. The image-reading device according to claim 11, further comprising a sending unit that sends the image data to an external device, wherein the plurality of reading modes includes a cover letter mode in which a type of sheets for a cover letter and a type of sheets for a document are defined, image data that is read in the cover letter mode being sent by the sending unit.

14. The image-reading device according to claim 13, further comprising a contact selecting unit that selects a contact to which the sending unit sends the image data; and a cover sheet number changing unit that changes a number of sheets for the cover letter according to the selected contact.

15. The image-reading unit according to claim 9, wherein the detecting unit executes a detection of the overlapped feed when the number of sheets having a same type is greater than or equal to two.

16. A sheet-medium-conveying device comprising:

a tray;

a conveying unit that is configured to feed a sheet from the tray;

a counter that is configured to count a number of sheets conveyed by the conveying unit;

a length measuring unit that is configured to measure a length of the sheet conveyed by the conveying unit;

a memory that is configured to store a reference length and a reference number; and a controller that is configured to control the conveying unit, the counter, the length measuring unit, and the memory, wherein if the number of sheets counted by the counter is zero, the controller controls the length measuring unit to measure a length of a sheet conveyed by the conveying unit and store the measured length of the sheet as a reference length in the memory, wherein if the number of sheets counted by the counter is greater than zero, the controller controls the length measuring unit to measure the length of the sheet conveyed by the conveying unit and compare the measured length with the reference length, wherein if the measured length is greater than the reference length, the controller determines and notifies that an overlapped feed in which at least two sheets are conveyed in a partially overlapped condition occurs whereas if the measured length is smaller than or equal to the reference length, the controller determines that the overlapped feed does not occur and the controller does not notify that the overlapped feed occurs, wherein the controller resets the counter to zero if the number of sheets that the counter counts reaches the reference number.

17. The sheet-medium-conveying device according to claim 1, wherein the determining unit determines that the type of sheet conveyed by the conveying unit is changed when the conveying unit conveys a predetermined number of sheets.

18. The image-reading device according to claim 9, wherein the determining unit determines that the type of sheet conveyed by the conveying unit is changed when the conveying unit conveys a predetermined number of sheets.

* * * * *